US005160142A

United States Patent [19]

Marshall

[11] Patent Number: 5,160,142

[45] Date of Patent: Nov. 3, 1992

[54] GOLF PUTTING TRAINING DEVICE

[76] Inventor: Perry C. Marshall, 103 Granada Ct. North, Plant City, Fla. 33567

[21] Appl. No.: 804,864

[22] Filed: Dec. 6, 1991

[51] Int. Cl.[5] ..... A63B 69/36

[52] U.S. Cl. ..... 273/186.2; 273/170; 273/162 B; 273/163 A

[58] Field of Search ..... 273/186 A, 170, 183 D, 273/163 R, 163 A, 164, 162 B, 194 R, 194 A, 194 B

[56] References Cited

U.S. PATENT DOCUMENTS 3,979,125 9/1976 Lancellotti ..... 273/170 X 4,135,720 1/1979 Lancellotti ..... 273/170 X

*Primary Examiner*—George J. Marlo

*Attorney, Agent, or Firm*—Joseph C. Mason, Jr.; Ronald E. Smith

[57] ABSTRACT

A putting aid for use by golfers in improving putting strokes is releasably attachable to a golf clubhead and includes a parallelepiped housing for a ball and a plurality of angularly disposed pockets into which the ball rolls during a putting stroke. The pocket within which the ball comes to rest indicates whether the putter blade was held square with an intended line of putt during the stroke, or at an angle that causes the putt to be missed. The ball rolls into a wedge-shaped recess formed in a bottom wall of the housing. The recess has a pointed leading end that points toward the cup when the putting aid is properly attached to the putter, and a wide, arcuate trailing end within which the pockets are formed. The pockets are spaced so that a swing that is more than one degree off from a perfect swing is indicated by the ball rolling into a pocket positioned out of alignment with the pointed leading end of the recess. Properly executed strokes result in the ball rolling into the center pocket directly behind the pointed leading end. An embodiment including a mercury globule provides more detailed information.

19 Claims, 5 Drawing Sheets

GOLF PUTTING TRAINING DEVICE

TECHNICAL FIELD

This invention relates to the game of golf. More particularly, it relates to a putting aid that enables a golfer to determine the position or angle of a putter blade relative to an intended putting line and which detects any deviation from said line, thereby improving the golfer's ability to strike putts correctly.

BACKGROUND ART

Putting strokes represent approximately 42% of the average golf round. During the putting stroke, the blade of the putter should be drawn directly back along the intended line of putt and then thrust forward, not deviating from the line, and the blade face should remain perpendicular to said line. Moreover, the putter blade should accelerate through the ball so that a true rolling action is imparted. This is important since a vertical spinning action on the ball will tend to keep it on the putting line.

If the face of the putter is one degree off from being perfectly perpendicular to the putting line at contact with the ball, there will be a deviation of 1.2" at five feet and a missed putt may result. Of course, the deviation increases or decreases as the length of the putt increases or decreases, respectively.

What is needed, then, is a putting aid that tells a golfer whether or not the stroke deviated from the intended line of putt and that further provides an indication as to the degree and direction of deviation. An ideal device would even indicate whether or not the putting stroke included a proper follow through.

The prior art, at the time the present invention was made and when considered as a whole in accordance with the requirements of law, neither taught nor suggested to those of ordinary skill in the putting aid industry how the art could be significantly advanced.

DISCLOSURE OF INVENTION

The present device is a recording and display instrument; it records the path of travel followed by a putter blade as it executes a putting stroke and displays to the golfer that path of travel so that correction can be made as needed.

In a first embodiment, a rigid, spherical ball is used to indicate whether the stroke was on target or off target by one degree or more. In a second embodiment, a mercury globule is used to provide more detailed information to the golfer. In a third embodiment, the path of travel of a rigid ball or a mercury globule is displayed in its entirety to provide even more information to the golfer.

All three embodiments include a small housing member that is detachably secured by suitable means at a right angle to a putter face. The housing is preferably of parallelepiped construction and has a clear top wall so that the interior of the housing is visible to the golfer when the putter is held in the well-known putting position.

All three embodiments also include a bubble level means attached to the housing to facilitate leveling of the housing with respect to the plane of the stroke.

All three embodiments further include a flat-bottomed, wedge-shaped recess formed in a bottom wall of the housing. The wedge points toward the hole when the device is properly attached to the clubhead. The device, when attached to the putter, is disposed at a ninety degree angle relative to the putter blade. The device is a practice device, i.e., it is removed during an actual round of golf.

In the first embodiment, a solid, rigid spherical ball is captured within the housing, and three independent pockets are formed in the arcuate-shaped trailing end of the wedge-shaped recess formed in the bottom wall of the housing. When the device is properly attached to the putter and the putter is stroked in a practice putt, the ball will roll into the leading (pointed) end of the wedge-shaped recess as the golfer executes the back stroke, and said ball will roll into one of the three pockets at the trailing end of the recess as the putting stroke is executed. If the stroke is perfectly executed, or nearly so, the ball will roll into the middle pocket of the three pockets, i.e., the pocket directly behind the pointed apex of the wedge-shaped recess. If the stroke was along a path of travel oblique to the ideal path of travel, the ball will roll into one of the outer pockets, depending on the direction of the stroke. Significantly, the ball will roll into one of the outer pockets even if the stroke is only one degree off an ideal stroke. Moreover, if the golfer fails to follow through, the ball will return to its starting position at the pointed end of the recess, thereby recording the effect of a stroke lacking a follow through.

In the second embodiment, a globule of mercury replaces the rigid ball; the housing is tightly sealed to ensure against escape of the mercury into the environment. The globule of mercury behaves in substantially the same manner as the rigid ball of the first embodiment. However, the globule has a diameter that is greater than the breadth of the pockets formed in the trailing edge of the recess. Thus, the globule breaks apart into two or more smaller globules and each globule comes to rest in different pockets. Advantageously, the proportional size of each globule conveys important information to the golfer. For example, a stroke that is about half a degree off the intended line of putt will produce two globules of equal size; one globule will come to rest in the center pocket, indicating that the stroke was about fifty percent correctly executed, and the other globule will come to rest in an adjacent pocket, indicating that the stroke was about fifty percent off target, and further indicating the direction in which the deviation was made. As another example, if a large globule containing about eighty per cent of the original amount of mercury comes to rest in the center pocket, and two smaller globules, each representing about ten percent of the original amount of mercury come to rest in the pockets flanking said center pocket, then the golfer knows that the stroke was exactly on target. In other words, the edges of the globule will shear off in equal sizes if the stroke is made precisely coincident with the intended line of putt because the diameter of the globule exceeds the circumferential extent of the pockets.

In the third embodiment, either the rigid ball of the first embodiment or the mercury globule of the second embodiment is employed. The bottom wall of the recess that supports the rigid ball or the mercury globule is sensitized to the presence of the ball by mechanical, chemical, electrical or optical means so that the actual path of travel of the ball as it travels from the pointed leading end to the arcuate trailing end of the wedge-shaped recess is recorded for the golfer's observation.

Thus, a stroke having more than one component will produce a trail that has bends therein, and the golfer will be able to tell which part of the swing was off target. A stroke having a single component will also be more accurately recorded in comparison to the pocket-reliant embodiments of the invention.

The primary object of this invention is to enable golfers to see what is wrong with their putting stroke so that appropriate correction can be made.

Another object is to accomplish the foregoing object with a small, inexpensive device that is readily attachable to and detachable from a putter.

A more specific object is to provide such a device that detects putting aiming errors where the club face is less than one degree out of its ideal alignment.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWING

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figure 1:
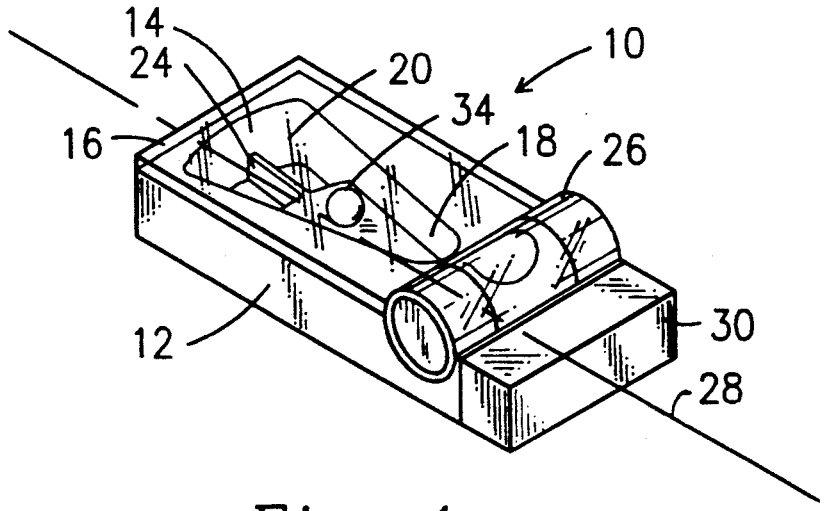
FIG. 1 is a perspective view of the first embodiment of the invention.

Referring now to FIGS. 1-4, it will there be seen that the first illustrative embodiment of the invention is denoted as a whole by the reference numeral 10.

Putting aid 10 has a generally parallelepiped construction as shown; it includes base member 12 having a wedge-shaped recess 14 formed therein, and a transparent closure member 16 that is fixedly secured in overlying relation to said base member 12.

Figure 3:
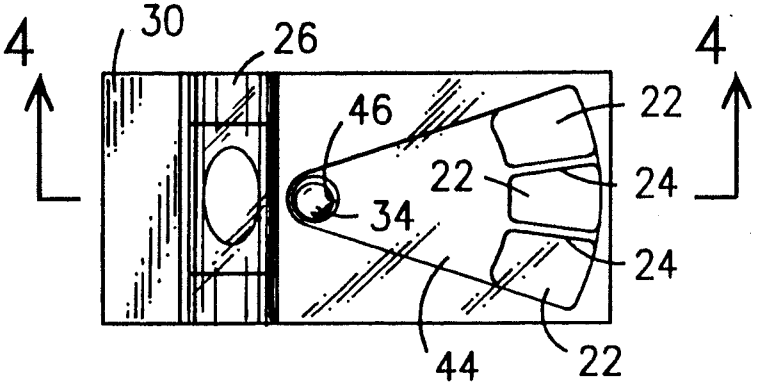
FIG. 3 is a top plan view of said first embodiment.

Recess 14 has a narrow or pointed leading end 18, a wide, arcuate trailing end 20, and a plurality of recessed pockets, collectively denoted 22, best shown in FIG. 3, formed adjacent said trailing end. Radial divider walls, collectively denoted 24, are provided to separate the pockets 22 from one another. Note that the pockets are circumferentially spaced with respect to one another; in this first embodiment, the pockets are spaced more than one degree apart from one another.

A bubble level 26 is fixedly secured by suitable means to base member 12 in transverse relation to the longitudinal axis of symmetry 28 of said base member. The level is employed to position the device 10 at its proper attitude; i.e., to position the device parallel to the plane of the stroke prior to execution of the stroke.

Figure 2:
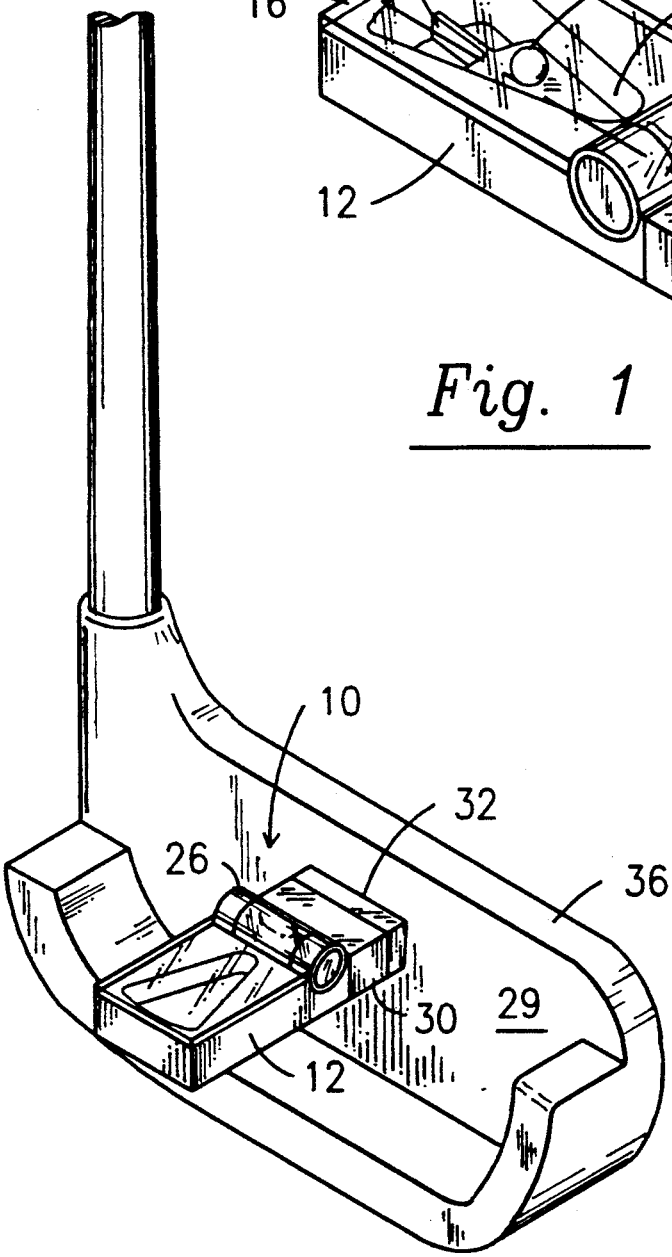
FIG. 2 is a perspective view of said first embodiment secured to the trailing face of a putter blade.
Figure 5:
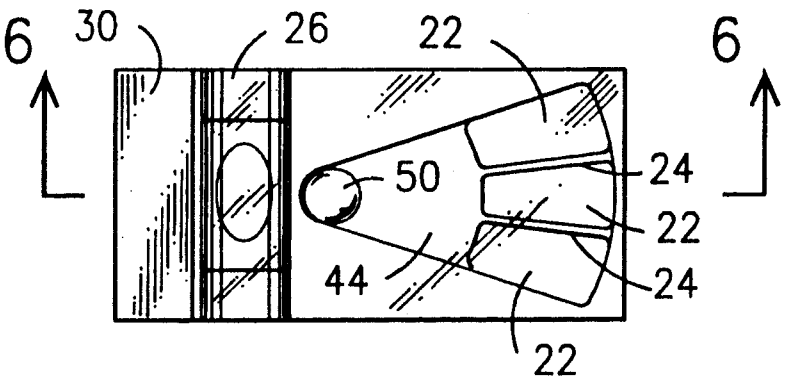
FIG. 5 is a top plan view of the second embodiment.
Figure 6:
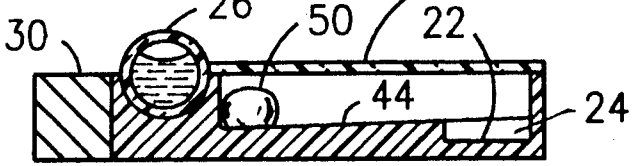
FIG. 6 is a sectional view taken along line 6—6 in FIG. 5.
Figure 14:
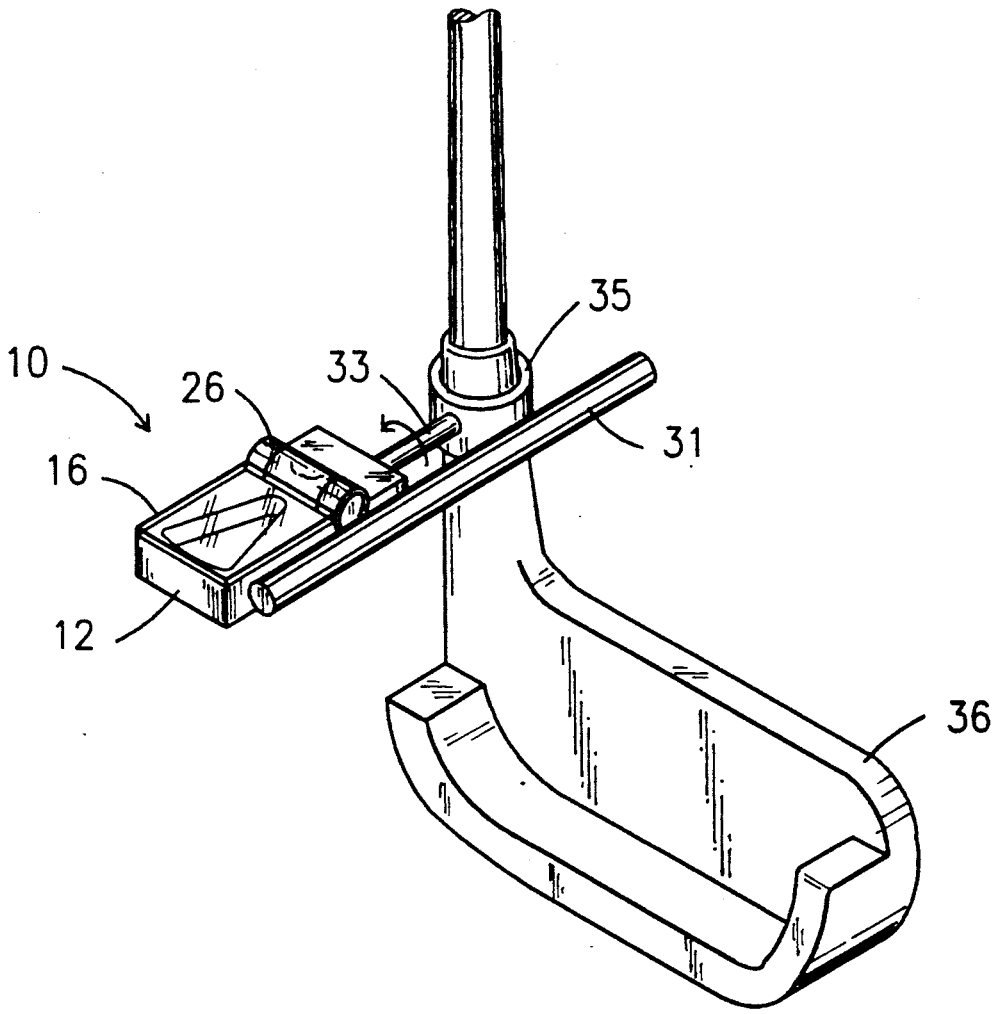
FIG. 14 is a perspective view of an alternative mounting of the novel device.

Putting aid 10 also includes a magnet 30 that is fixedly secured by suitable means to the leading end of aid 10 if said aid is detachably secured to the trailing face 29 of the putter as depicted in FIG. 2. If the golfer preferred to attach aid 10 to the leading face of the putter blade, the magnet would then be fixedly secured to the trailing end of aid 10, but the pointed end 18 of the wedge would still point toward the cup. Some golf putters are made of a ferrous material; magnet 30 attaches to said putters without modification. However, for putters made of non-magnetic material, a thin, flat sheet or shim 32 (FIG. 2) of a magnetic material is fixedly secured to the trailing face 29 of the putter to provide a mounting surface for the magnet if the trailing configuration of FIG. 2 is preferred. The above-mentioned leading mounting would of course require shim 32 to be mounted on the leading face of the putter. In view of this disclosure, it now becomes apparent that a variety of other fastening means, not reliant upon magnetism, could be employed and all such other fastening means are well within the scope of this invention. For example, as shown in FIG. 14, the device may also be attached to the hosel of the putter. Rod 31 is placed against a square surface to position device 10 ninety degrees from the putter face. Rod 33 pivotally interconnects device 10 to collar 35 that is clampingly secured to the hosel as shown; the pivotal interconnection enables positioning of device 10 at the proper attitude as indicated by level 26.

Figure 11:
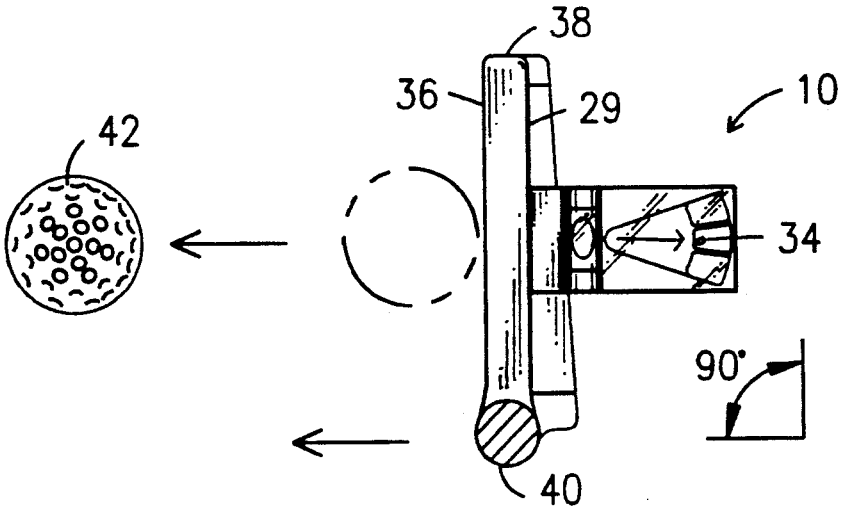
FIG. 11 is a diagrammatic plan view of an exemplary golf putt that depicts the action of the novel training aid when used by a right-handed golfer.
Figure 12:
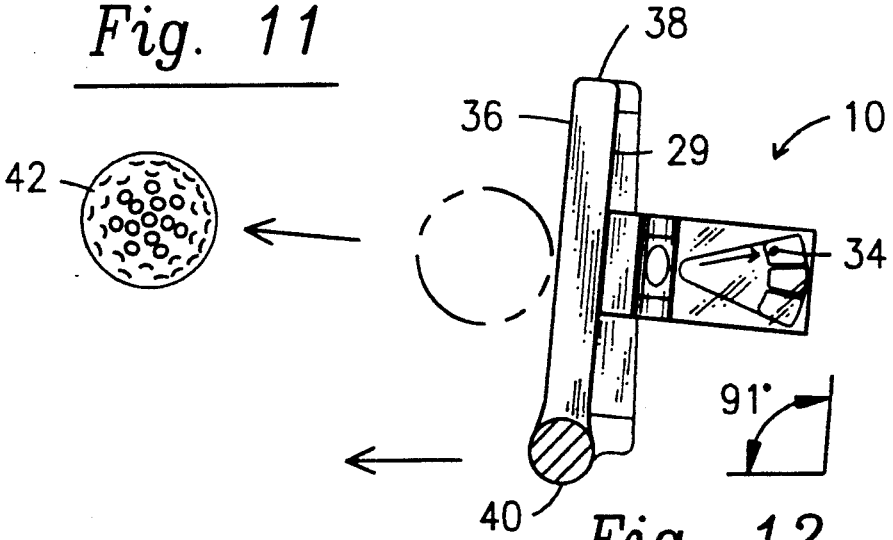
FIG. 12 is a view similar to that of FIG. 11.

The ball 34 of FIGS. 1-4 is preferably a metallic, spherical rigid ball; note that the diameter of said ball is less than the breadth of each pocket. As shown in FIG. 3 only three pockets 22 are provided in this particular embodiment, but it should be understood that more pockets could be provided and that the size of ball 34 could be reduced accordingly. The operation of this first embodiment is perhaps best understood in connection with FIGS. 11-13. A square putt, as depicted in FIG. 11, will cause ball 34 to roll straight back into the middle pocket, thereby recording that the golfer made a putt that propelled a golf ball directly along, i.e., coincident with, the intended line of putt. However, as depicted in FIG. 12, if the golfer holds the clubhead 36 at an obtuse angle when executing the putting stroke, i.e., so that toe 38 is further from the hole than heel 40 (an "open" putt), the path of the golf ball 42 will be errant and a short putt may be missed if said obtuse angle is ninety one degrees or more. Where such an obtuse putt is made by a right-handed golfer, the ball 34 comes to rest in the upper pocket as depicted in FIG. 12 and thereby advises the golfer that the club was held at an obtuse angle during the stroke. This is very valuable information, because such information is provided even if the angle of the clubhead was only one degree off from the perfect angle. Without the information, the golfer will be baffled as to why the shots do not fall, because a one degree error in alignment of the clubhead is otherwise difficult to detect.

Figure 13:
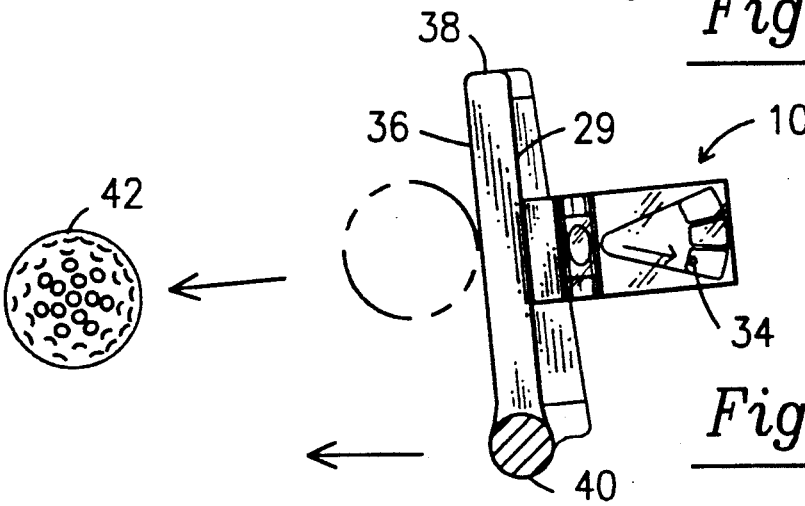
FIG. 13 is a view similar to that of FIG. 11.

FIG. 13 depicts the final position of the ball when the golfer holds the putter at an acute angle, i.e., eighty nine degrees or less (where the angle depicted in FIG. 11 is ninety degrees); this is known as a "closed" putt.

Figure 4:
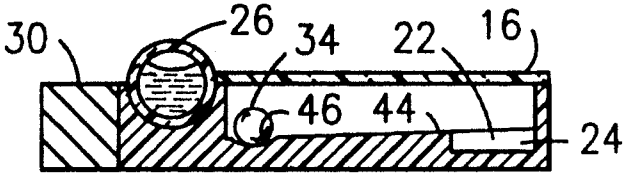
FIG. 4 is a sectional view taken along line 4—4 in FIG. 3.

Note in FIGS. 3 and 4 that the bottom wall of the novel recording device 10 is denoted 44, that ball 34 rests in a depression 46 when in its forwardmost position, and that pockets 22 are also depressions formed in said bottom wall 44. The depth of forward depression 46 is less than the depth of the rearward depressions 22 because it is desired that ball 34 easily depart from its depression 46 when the clubhead is swung, but it is desired that said ball remain in the pockets 22 after the clubhead has been swung so that the information provided by the final position of the ball may be extracted.

Although not critical to the operation of the device 10, the depth of each pocket 22 is slightly greater than the radius of ball 34 so that the ball does not exit the pocket within which it came to rest before the golfer has the opportunity to observe it.

The mercury unit is shown in FIGS. 5–10; note that no forward depression is provided in this embodiment and that mercury globule 50 is somewhat elongated by the influence of gravity. The mercury embodiment performs in the same way as the rigid metal ball embodiment, but the globule of mercury, preferably, has a diameter greater than the breadth (or circumferential extent) of each pocket. Accordingly, the mercury globule will split apart when it enters the pockets and the size of the globules will advise the golfer as to what percentage of the putt was on the intended line of putt and in which direction the deviation occurred. This will be more fully explained in connection with the third embodiment.

Figure 8:
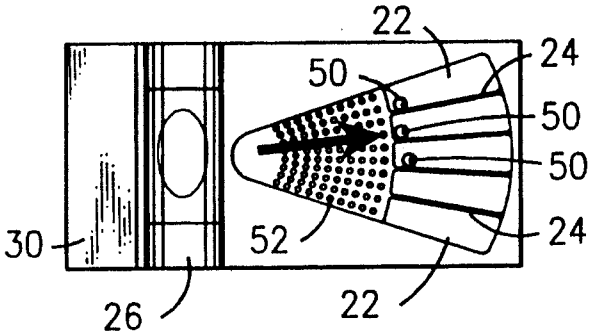
FIG. 8 is a top plan view of said third embodiment, showing the effect of a stroke that was slightly off target.
Figure 7:
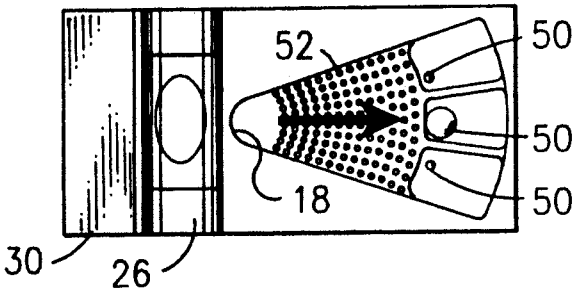
FIG. 7 is a top plan view of a third embodiment, showing the effect of a perfect stroke.

FIGS. 7 and 8 depict said third embodiment; although this third embodiment may take many different forms, the embodiment shown provides mechanical means for disclosing the path of travel of a mercury globule 50 as it traverses bottom wall 44 of the recording device 10. A large plurality of closely spaced small dimples or recesses, collectively denoted 52, are formed in said bottom wall 44. As the globule 50 travels from apex 18 to trailing end 20 of the wedge-shaped recess 14, small globules of mercury break off and are captured by the dimples traversed, thereby leaving a path that shows the actual path of travel of the main globule 50.

Figure 10:
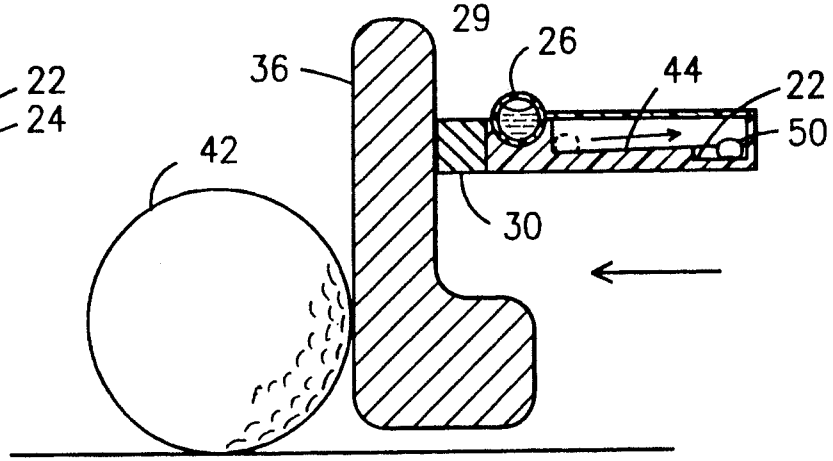
FIG. 10 is a view similar to FIG. 8, but showing the forward swing of the putter.
Figure 9:
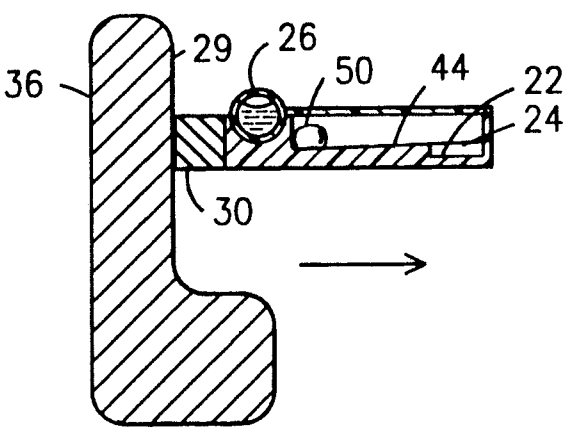
FIG. 9 is a sectional, side elevational view of the third embodiment attached to the trailing face of a putter, showing the position of the mercury globule at the commencement of the backswing.

FIGS. 9 and 10 show how the ball 34 or globule of mercury 50 stays in its forwardmost position as the backswing is executed for a right-handed golfer (FIG. 9) and how it travels to the pockets 22 during the forward stroke if the golfer follows through. The device 10 works with left-handed golf clubs as well, of course.

FIG. 7 shows the effect of a perfect stroke. The globules in the outer pockets are of the same size, indicating that globule 50 entered the exact center of the center pocket. FIG. 8 is a five pocket embodiment, and is therefore capable of providing even more information to the golfer.

The use of dimples so that the mercury globule will leave a track is one of many methods that could be used to reveal the actual path of travel of said globule. All other methods of revealing said path of travel are within the scope of this invention.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A golf putting training aid, comprising:

a base member;

a wedge-shaped recess formed in said base member;

said recess having a bottom wall;

said recess having a narrow leading end and a wide trailing end;

attachment means for releasably attaching said base member to a putter so that said base member is oriented in a predetermined position relative to said putter;

said narrow leading end of said base member being disposed in leading relation to said wide trailing end of said base member during swinging of a putter toward a golf ball during a putting stroke, said orientation of said base member being said predetermined position;

a plurality of pockets formed in said bottom wall along the trailing end of said recess; and a generally spherical ball positioned atop said bottom wall;

the structural characteristics of said recess and ball being such that a backswing of said putter having said base member secured thereto drives said spherical ball toward the leading end of the recess; and the inertia of said spherical member causes it to roll into one of said pockets during said putting stroke of said putter so that a record is thereby created of the path of travel of said putter during said putting stroke.

2. The training aid of claim 1, further comprising a leveling means secured to said base member in transverse relation to a longitudinal axis of symmetry of said base member.

3. The training aid of claim 1, wherein said generally spherical ball is a solid spherical ball of rigid metallic construction.

4. The training aid of claim 1, wherein said generally spherical ball is a globule of mercury.

5. The training aid of claim 4, further comprising a plurality of small, closely spaced dimples formed in said bottom wall so that said globule of mercury leaves a trail of small mercury globules in each dimple over which it passes to thereby leave a history of its path of travel during a forward stroke of said putter.

6. The training aid of claim 1, further comprising a transparent closure member fixedly secured to said base member in overlying relation thereto to retain said generally spherical ball within said training aid and to permit viewing of said ball.

7. The training aid of claim 1, wherein said base member is of parallelepiped construction.

8. The training aid of claim 1, further comprising a plurality of divider walls that separate said pockets from one another.

9. The training aid of claim 1, wherein said pockets are circumferentially spaced about one degree apart from one another.

10. The training aid of claim 1, wherein said attachment means includes a magnet fixedly secured to said base member.

11. The training aid of claim 1 wherein said putter is a part of said training aid, and further comprising shim means, made of ferrous material fixedly secured to a preselected face of said putter, and wherein said attachment means includes a magnet fixedly secured to said base member.

12. The training aid of claim 1, wherein each of said pockets has a predetermined depth greater than a radius of said ball so that said ball remains in a pocket upon completion of a forward stroke of said putter.

13. A golf putting training aid of the type attached to a putter, comprising:

a base member of generally parallelepiped construction;

said base member having a bottom wall;

a wedge-shaped recess formed in said bottom wall, said recess having a pointed leading end and an arcuate trailing end;

a transparent top wall disposed in overlying relation to said base member;

a generally spherical ball member disposed in captured relation within said base member;

a plurality of recessed pocket members formed in said trailing end of said wedge-shaped recess;

each of said pocket members having a common, predetermined breadth;

a bubble level member disposed in transverse relation to said base member;

releasable fastening means for releasably mounting said base member to a preselected face of said putter; and said pointed leading end of said recess being pointed in the direction of a target when the putter to which it is attached is swung.

14. The training aid of claim 13, wherein the plurality of pocket members is three and wherein said three pocket members are separated from one another by a pair of divider walls.

15. The training aid of claim 13, wherein the generally spherical ball member is of rigid, metallic construction.

16. The training aid of claim 13, wherein the generally spherical ball member is a globule of mercury, and wherein said globule of mercury has a diameter greater than said predetermined breadth of each of said pocket members.

17. The training aid of claim 16, further comprising a plurality of closely spaced, small dimples formed in said bottom wall.

18. The training aid of claim 13, further comprising a shallow depression formed in the leading end of said wedge-shaped recess.

19. The training aid of claim 18, wherein each of said pocket members has a depth slightly greater than a radius of said spherical ball member.

* * * * *